US009809968B1

(12) United States Patent
Holbrook et al.

(10) Patent No.: US 9,809,968 B1
(45) Date of Patent: Nov. 7, 2017

(54) LEACHING CHAMBER HAVING SIDEWALL WITH TENCED LOUVERS

(71) Applicants: Paul R Holbrook, Old Saybrook, CT (US); Roy E Moore, Jr., Killingworth, CT (US); Bryan A Coppes, Old Saybrook, CT (US)

(72) Inventors: Paul R Holbrook, Old Saybrook, CT (US); Roy E Moore, Jr., Killingworth, CT (US); Bryan A Coppes, Old Saybrook, CT (US)

(73) Assignee: INFILTRATOR WATER TECHNOLOGIES, LLC, Old Saybrook, CT (US)

( * ) Notice: Subject to any disclaimer, the term of this patent is extended or adjusted under 35 U.S.C. 154(b) by 67 days.

(21) Appl. No.: 14/839,460

(22) Filed: Aug. 28, 2015

Related U.S. Application Data

(60) Provisional application No. 62/043,362, filed on Aug. 28, 2014.

(51) Int. Cl.
*E03F 1/00* (2006.01)

(52) U.S. Cl.
CPC ..... *E03F 1/003* (2013.01)

(58) Field of Classification Search
CPC ..... E03F 1/003
See application file for complete search history.

(56) References Cited

U.S. PATENT DOCUMENTS

| | | | | |
|---|---|---|---|---|
| 4,523,613 | A * | 6/1985 | Fouss | E02B 11/005 138/121 |
| 4,759,661 | A * | 7/1988 | Nichols | E03F 1/003 138/105 |
| 5,511,903 | A * | 4/1996 | Nichols | E03F 1/003 405/36 |
| 6,443,652 | B1 | 9/2002 | Houck | |
| 6,854,925 | B2 | 2/2005 | DiTullio | |
| 7,207,747 | B1 | 4/2007 | England | |
| 2007/0077122 | A1* | 4/2007 | Birchler | E03F 1/003 405/46 |
| 2007/0258770 | A1* | 11/2007 | Miskovich | E03F 1/003 405/43 |
| 2010/0008727 | A1* | 1/2010 | DiTullio | E03F 1/003 405/49 |
| 2015/0043972 | A1* | 2/2015 | Wynne | E03F 1/003 405/43 |

FOREIGN PATENT DOCUMENTS

| | | |
|---|---|---|
| EP | 0 372 995 A2 | 8/1989 |

* cited by examiner

*Primary Examiner* — John Kreck
(74) *Attorney, Agent, or Firm* — C. Nessler

(57) ABSTRACT

A corrugated thermoplastic leaching chamber has sidewall louvers that define sidewall slot openings. Each louver comprises an outward extending canopy, a cap integral with the outer end of the canopy, having a down slope greater than the slope of the canopy, and a preferably concave fence at the inner end of the canopy, for inhibiting ingress of soil. The chamber may be made by first thermoforming sheet material, preferably two-layer PET plastic sheet to the shape of the chamber, followed by mechanically cutting and deforming the sidewall, to create the opening and the fence.

16 Claims, 7 Drawing Sheets

LEACHING CHAMBER HAVING SIDEWALL WITH TENCED LOUVERS

This application claims benefit of provisional patent application Ser. No. 62/043,362, filed on Aug. 28, 2014.

TECHNICAL FIELD

The present invention relates to arch shape cross section plastic chambers suited for burial in soil and receiving and dispersing liquids, in particular leaching chambers for wastewater disposal systems.

BACKGROUND

Polyethylene terephthalate, commonly called PET, is a particular thermoplastic, widely used in plastic bottles and thus something that society wants to recycle. PET is used in bottles for its special properties, for instance, for containing carbonated beverages and being chemically non-reactive to the beverages. When used in fibers, the same PET material is often commonly called polyester.

The present invention relates in part to the technology for using recycled and virgin PET in products which would otherwise be wholly made of polyethylene (PE) or polypropylene (PP). There are variances in supply and cost amongst recycled plastic raw materials; and, in that context it is attractive to use PET for structural items such as molded plastic leaching chambers and storm chambers. A historic problem is that the properties of recycled thermoplastics tend in general to be inferior to virgin materials. Nonetheless, it would be desirable to make products, in particular leaching chambers and other arch shape cross section chambers having perforated sidewalls from recycled PET, alternatively from virgin PET, for the benefit of better mechanical properties such as impact resistance than are provided by some other common plastics used in leaching chambers, such as polypropylene PP and polyethylene PE.

Leaching chambers of PP and PE have heretofore been made by methods which include thermoforming of sheet and injection molding. While a disadvantage of injection molding is the cost of molds and molding equipment, injection molding has been desirable because it provides precise wall thicknesses compared to thermoforming and does not require a secondary operation to make sidewall perforations. Recycled PET presents problems to injection molding, particularly with respect to flowing the plastic and filling small channels of an injection molding mold.

Leaching chambers made by thermoforming have been heretofore marketed with cut hole perforations in the sidewalls. A thermoformed leaching chamber made of PP or PE might have a wall thickness which varies between 0.08 inch and 0.16 inch. To use such chambers in common soil including sandy soil, they have to be covered with geotextile, otherwise soil will migrate to the interior of the chamber through the sidewall holes.

In comparison injection molded chambers have sidewall slots and associated louvers, and they present less need for geotextile, along with a more desirable exposure of the soil at the opening in the sidewall of the chamber. During use, leaching chambers are buried in soil and it is desirable to inhibit any tendency of the surrounding soil to enter the chamber interior through the sidewalls. Thus, the configuration of slotted sidewalls has varied over time in commercial products as has been described in patent literature. Generally, the slots are defined vertically by spaced apart horizontal louvers which typically have smooth underside and topside surfaces. Typically, the louvers have wedge shape cross sections. Sometimes, the louvers of injection molded leaching chambers have a lip or ridge at the innermost edge of the top surface of a louver. See for instance, Birchler et al. Pat. Pub. 20070077122 and England U.S. Pat. No. 7,207,767.

SUMMARY

An object of the invention is to provide an arch shape cross section chamber, preferably useful as a leaching chamber, with an improved sidewall which has louvered openings. Another object of the invention is to make a strong, light weight leaching chamber by a combination of thermoforming and mechanical working, particularly, to make a chamber of PET thermoplastic material.

In an embodiment of the present invention, an arch shape cross section corrugated plastic chamber has a plurality of peak corrugations, each of which has a plurality of openings, preferably slots, that are defined by spaced apart louvers. Each louver comprises (a) a canopy running outwardly and sloping downwardly; (b) a cap, integral with the outer end of the canopy, running outwardly and sloping downwardly with a slope which is greater than the slope of the canopy; and (c) a fence integral with the inner end of each canopy, the fence running upwardly from said inner end of the canopy to an upper fence edge. In embodiments of the invention, the ends of the fence are connected to the sidewalls of the peak corrugations, and the upper edge of the fence has a concave shape, projected in the horizontal plane, optionally also concave when projected into the vertical plane.

Compared to wedge shape cross section and flat-underside louvers in prior art chambers, the preferred louvers in the invention have contoured underside surfaces that are nominally parallel to, or congruent with, the top surfaces, and therefore the louvers may be said to have nominally constant thicknesses.

Preferably the chamber is formed from a sheet of plastic such as recycled or virgin PET. The sheet is first thermoformed into an arch shape cross section chamber precursor having peak corrugations with undulations. The undulations of the sidewalls are then mechanically cut and deformed by tooling, to create the desired louvers.

A chamber of the present invention is light weight, structurally sound, and configured for preventing the ingress of surrounding soil into the interior of the chamber through the slot openings. The foregoing and other objects, features and advantages of the present invention will become more apparent from the following description of preferred embodiments and accompanying drawings.

DESCRIPTION

As mentioned in the Background, arch shape cross section leaching chambers having slotted sidewalls, and their manner of use, are well known. Reference may be made to U.S. Pat. Nos. 7,914,230, 7,465,122, 7,189,027, 5,511,903, and 4,759,661, the disclosures of which are hereby incorporated by reference. In the present invention, an exemplary leaching chamber has sidewalls with corrugations and slot openings that are unique. An exemplary chamber is preferably made of thermoplastic, including polyethylene terephthalate (PET). Other useful materials include polyethylene or polypropylene or another polyolefin. This description refers to leaching chambers because that is the anticipated prevalent use of the invention chambers. However, in the claimed invention, such nomenclature will comprehend chambers which are used for other purposes, for instance, for receiving and dispersing storm water, or for draining water from soil.

A leaching chamber of the present invention may be fabricated in several ways. For example, a chamber may be formed by injection molding, blow molding, and compression molding. Another way is to first thermoform a leaching chamber precursor from sheet material, then to mechanically perforate and deform local portions of the chamber sidewalls using dies, to create slot openings. The next part of this description is about that way of making an embodiment of a chamber.

Figure 1:
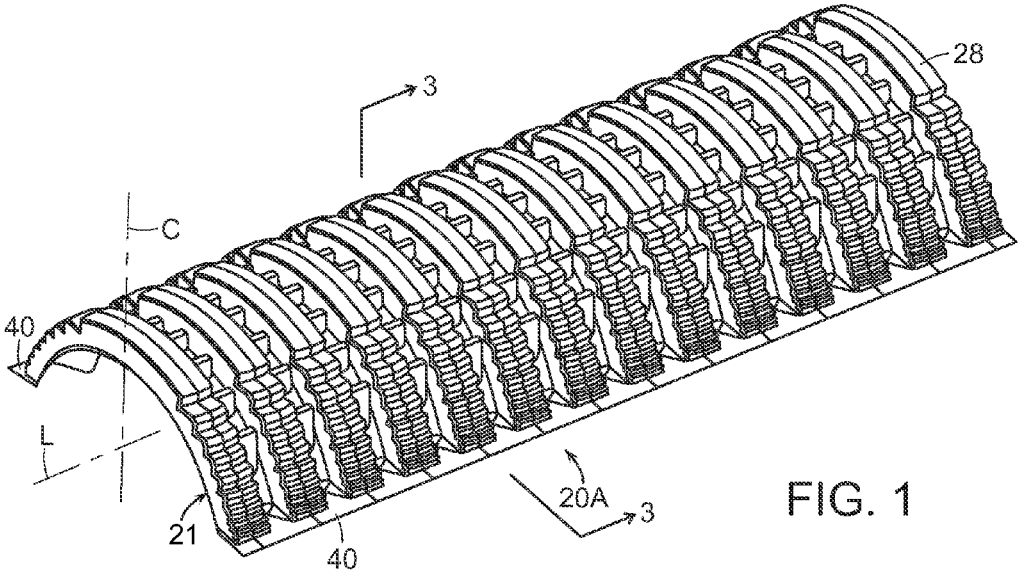
FIG. 1 is perspective view of a thermoformed precursor leaching chamber, prior to creation of the slot openings.
Figure 2:
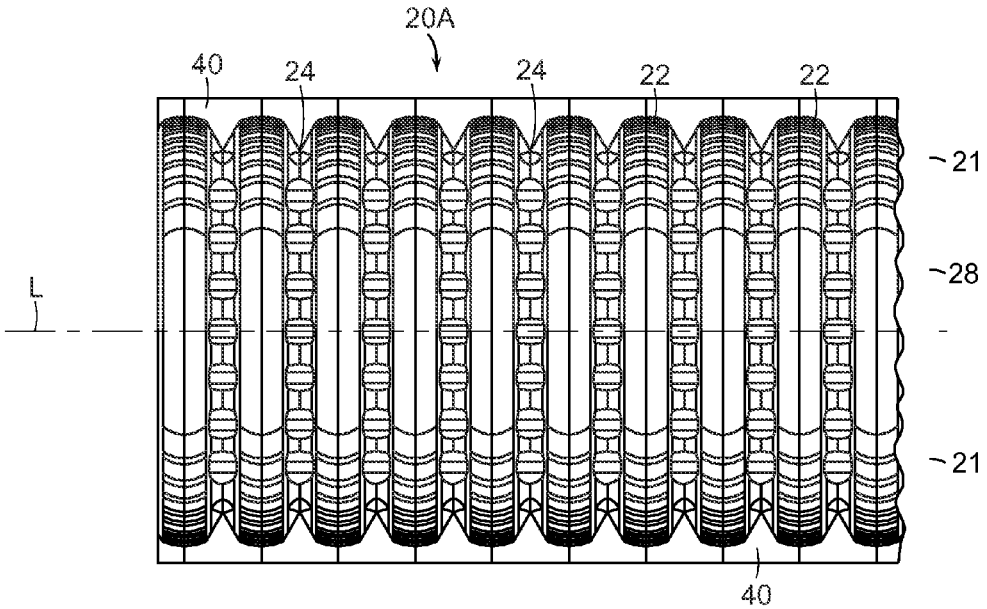
FIG. 2 is a partial top view of the chamber precursor shown in FIG. 1.

FIG. 1 is a perspective view of an uncompleted chamber 20A which has been thermoformed, and FIG. 2 is a partial top view. Chamber 20A is called a chamber precursor here, since it needs to be provided with further sidewall features and with the openings of a finished chamber. When the sidewalls 21 are worked, as described below, to provide slots and associated sidewall details, chamber 20A is converted to chamber 20. During use, water flows outwardly through openings (slots) in the sidewalls. A chamber sidewall of the present invention is shaped to inhibit inflow through the sidewall openings of soil that surrounds the chamber during use.

Chamber 20A has a length axis L, a vertical axis C, a top 28, opposing side base flanges 40, and opposing sidewalls 21, each of which runs upwardly from a base flange to the top. Chamber 20A and chamber 20 are generally arch shape in cross section. The arch structure defines an interior space for receiving water during use, which water subsequently flows downwardly and laterally into the surrounding soil. Chambers 20A, 20 have alternating peak corrugations 22 (also called "peaks") and valley corrugations 24 (also called "valleys") which run transverse to the chamber length. The peaks and valleys provide the chamber with strength to resist overlying loads when the chamber is buried in soil during use. Each peak has arch-curving (i.e., upwardly running) sides which, in the chamber lengthwise direction, transition indefinitely into the arch-curving sides of the adjacent valleys. The shared sides of the peaks and valleys have been referred to as webs in some prior patents.

A representative chamber embodiment may be about 23 inches wide, 8 to 12 inches high and 48 inches long. For reference purposes, a chamber (and a chamber precursor) has a horizontal plane direction; the base flanges lie in the bottommost horizontal plane of the chamber, also called the base plane; and a chamber has a width which is perpendicular to the chamber length. The width direction is also called the transverse direction. A chamber has a vertical center plane which runs lengthwise and contains axes C and L.

As detailed next, the peak corrugations have undulations along their arch curve shapes. In preferred embodiments of the present invention, chambers (chamber precursors and finished chambers) have valleys which lack the kind of undulations that characterize the peaks. Preferably, valleys have small lengthwise running ribs that connected the opposing arch-curving sides of the valleys (which sides are shared with the peaks). Optionally, within the invention, the valleys may have undulations with perforations, similar to the peaks.

Figure 3:
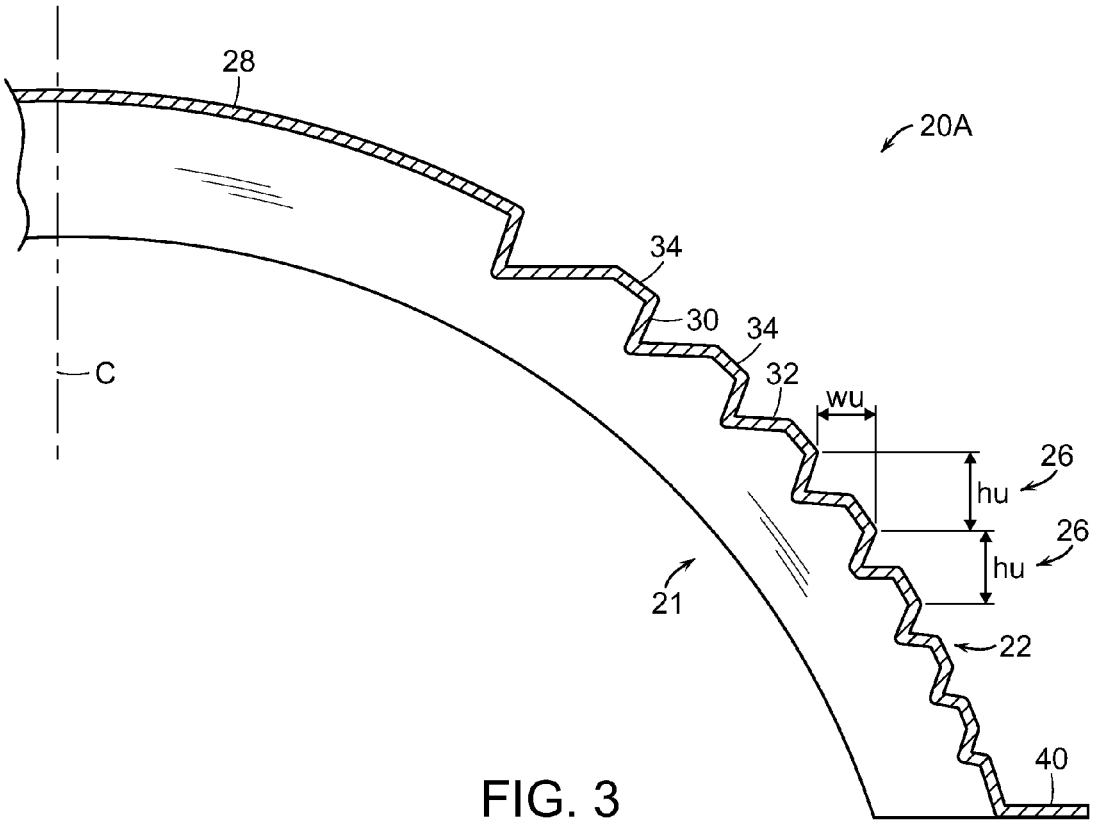
FIG. 3 is a transverse cross section of half of the chamber of FIG. 1.

FIG. 3 shows half of the transverse cross section of chamber precursor 20A, where the sectioning is along the center point of a peak corrugation 22. See also the same kind of detail in FIG. 4. Each peak corrugation 22 of a chamber sidewall 21 comprises a plurality of undulations 26. Each undulation is adjacent to another undulation along the curve of the peak corrugation as it rises from the base flange. In one embodiment, pictured in the Figures here, the undulations have constant height hu and changing width wu (the dimension in the transverse plane of a chamber) with height. The changing width is due to the change in slope of the sidewall as it runs upwardly toward the top of the chamber. In other embodiments of the invention, one or both of the dimensions hu and wu may vary with elevation from the base flange.

Figure 4:
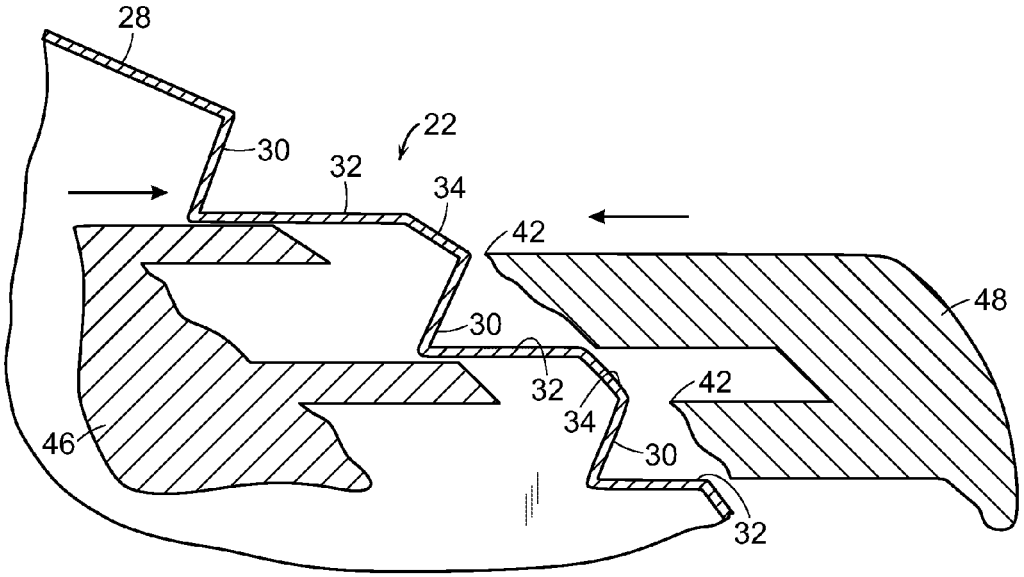
FIG. 4 is a partial transverse cross section of the sidewall of the chamber of FIG. 1, along with tools which are positioned for creating slot openings.

With reference to FIG. 3 and FIG. 4, each undulation 26 is comprised of three portions: canopy 32, lip 34, and subwall 30. Canopy 32 provides an exterior surface which extends laterally outwardly with respect to the chamber precursor center plane. The canopy is preferably slightly sloped downwardly with respect to the horizontal plane of the chamber. Lip 34 runs outwardly from the outer end of canopy 32 and slopes downwardly more steeply than the canopy. Sub-wall 30 runs downwardly and inwardly from the outer end of lip 34, connecting the outermost end of lip 34 to the innermost end of the canopy 32 of the underlying undulation.

Figure 5:
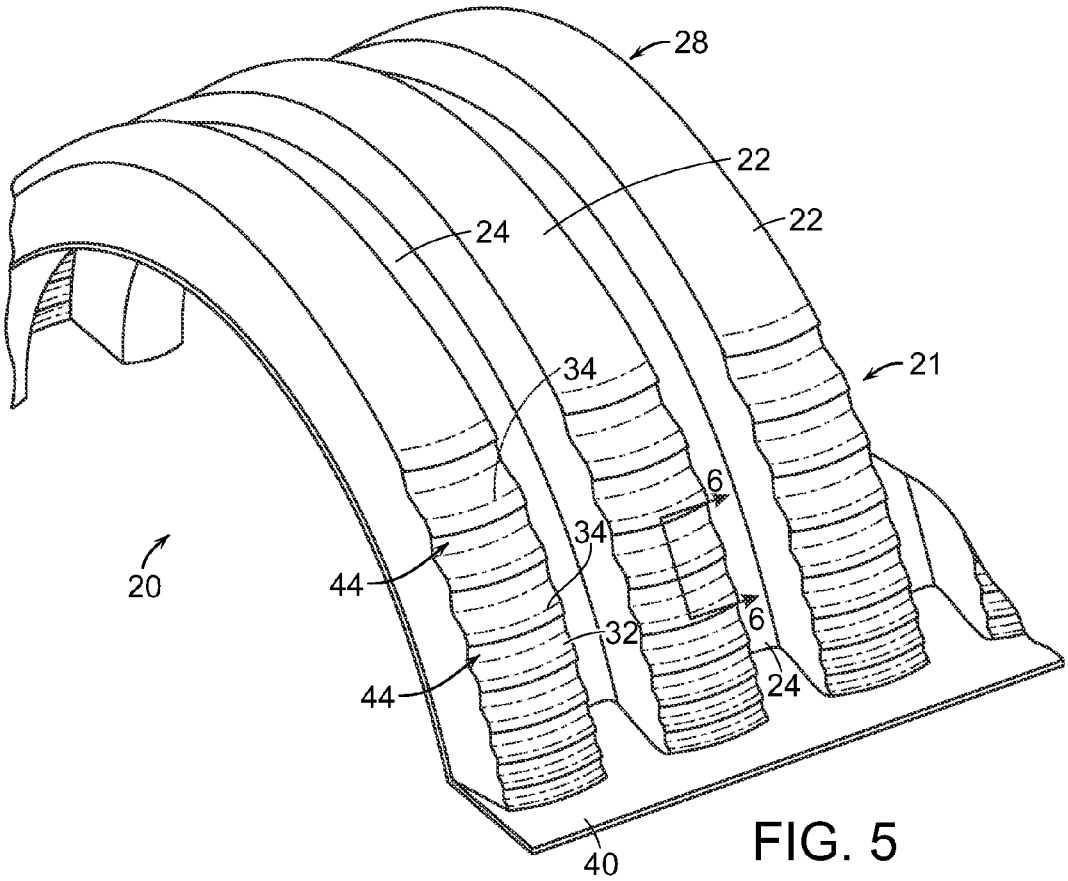
FIG. 5 is a perspective view of a portion of a slotted-sidewall chamber of the present invention.

To make a chamber 20, partially shown in FIG. 5, chamber precursor 20A is subjected to a punching and forming operation which creates a plurality of openings, preferably slots, in the peak where it has undulations. Resultant local portions of the sidewall, referred to hereafter mostly as louvers, which define the slot openings, are uniquely shaped.

Figure 4B:
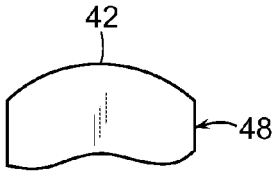
FIG. 4B is a top view of a portion of one of the tools shown in FIG. 4.
Figure 4A:
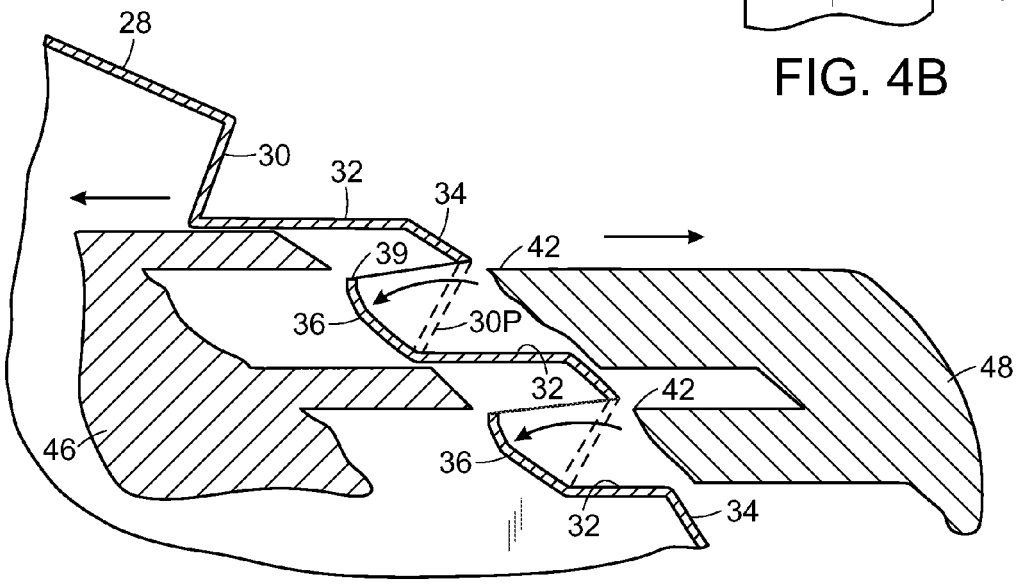
FIG. 4A is a view like FIG. 4, showing the sidewall after slots have been formed and the tools have been withdrawn.
Figure 6:
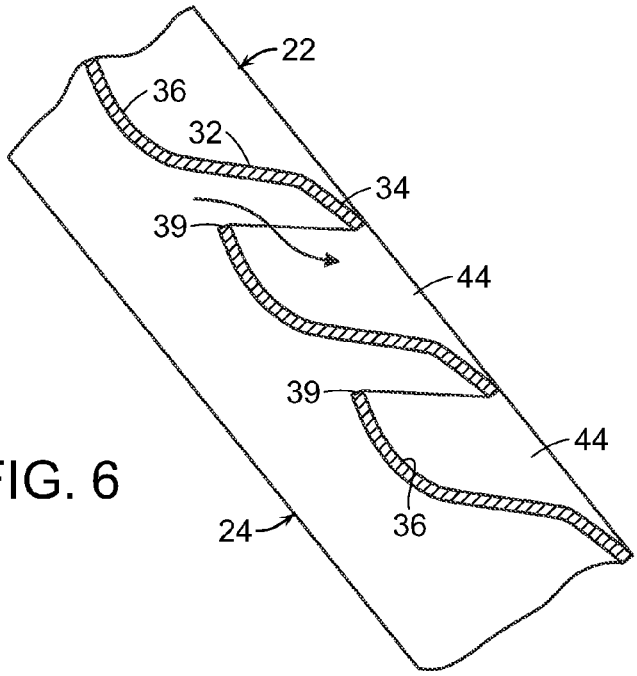
FIG. 6 is a transverse cross section through a portion of the sidewall of the chamber in FIG. 5.

FIG. 4 and FIG. 4A illustrate one way in which the sidewalls are fabricated by tools 46, 48. FIG. 4 shows a vertical cross section of a portion of corrugation 22 of chamber precursor 20A, in particular, the two uppermost undulations which are near chamber top 28. Also shown are two mating tools: an essentially female tool 46 within the interior of the chamber precursor and an essentially male tool 48 at the exterior of the chamber precursor. In FIG. 4, the tools are shown in a "before" position, poised for contact with the sidewall toward which they will move as indicated by the arrows, to both perforate and form the sidewalls. In FIG. 4A, the tools are shown in the withdrawn or "after" position, having created the slot openings 44. A portion of the "after" sidewall is also illustrated in FIG. 6.

Referring to FIG. 4, 4B, the leading edge 42 of tool 48 acts against tool 46 when tool 46 is in contact with the interior of the chamber sidewall. That action first cuts the upper end of canted subwall 30 where it meets lip 34. The cutting is possible due to the presence of the cap; it provides a place for the tool 46, which supports the undulation under the force of the upper part of tool 48. The subwall is at the same time deformed by stretching of the upper cut edge 39 of subwall. FIG. 4A shows how subwall 30, shown as phantom subwall 30P has been cut and pushed inwardly.

FIG. 4B is a top view of tool 48 showing the contoured leading edge 42 which deforms the sidewall and creates a fence 36. Comparing the side view of the tool in FIG. 4 and the top view in FIG. 4B, the tools create a complexly shaped fence.

Only one two-undulation/two-slot tool is shown in the illustrations here. More complicated tools may be used to fabricate more undulations, up to modifying an entire corrugation or an entire chamber sidewall in other embodiments. Economics and production rate will dictate how complex the tools 46, 48 may be. To facilitate the forming operation, heating of the subwall 30P or the whole of the sidewall may be used. In alternative fabrication approaches, cutting and shaping of the sub-wall may be carried out in separate operations.

Figure 7:
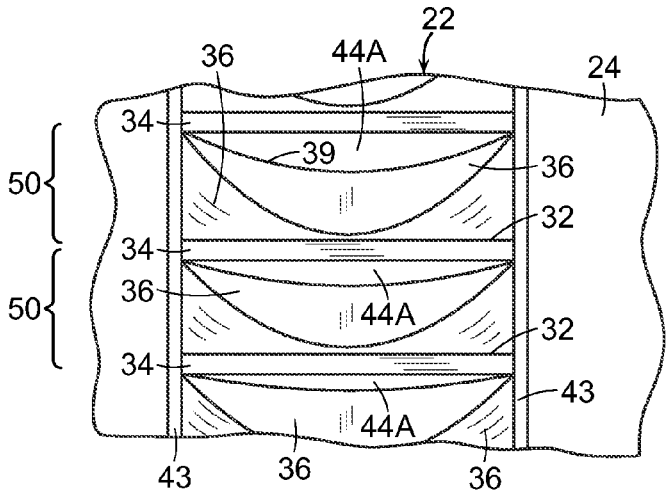
FIG. 7 is a side elevation view of a portion of the sidewall of the chamber of FIG. 5.
Figure 8:
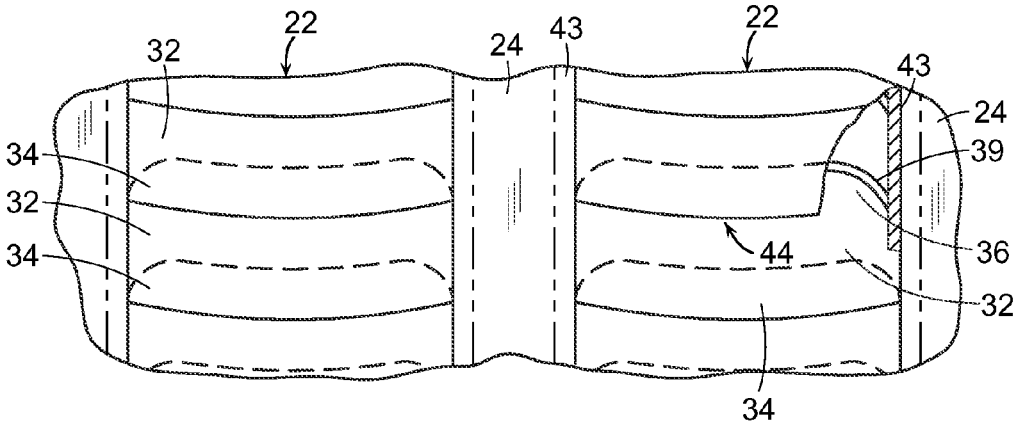
FIG. 8 is a top view, partially cutaway, showing a portion of the sidewall of the chamber of FIG. 5.
Figure 9:
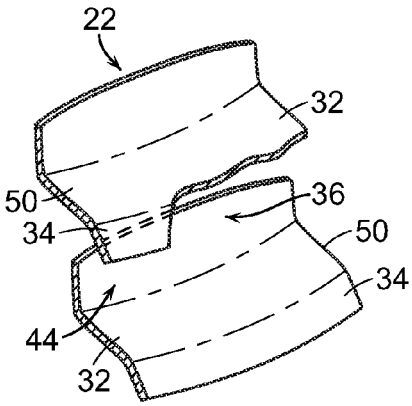
FIG. 9 is a partial cutaway view of a portion of the sidewall of the chamber of FIG. 5.

FIG. 5 is a perspective side view of a portion of a chamber 20 with a sidewall 21 that has been perforated and formed by the just-described operations. FIG. 6 is a partial cross section through the center of a peak corrugation 22 of chamber 20. FIG. 7 is a side elevation view of a portion of the sidewall of chamber 20, and FIG. 8 is a top view of a portion of the sidewall. FIG. 9 is a partial cutaway view of a portion of a peak corrugation 22 of the chamber 20 showing two louvers 50.

With reference to FIG. 5-9, a preferred embodiment of chamber has a sidewall with a plurality of complex geometry slot openings 44. As can be best seen in FIG. 6 and FIG. 9, each opening provides a serpentine path (illustrated by a serpentine arrow in FIG. 6) along which water may flow outwardly through the chamber sidewall from the chamber interior. The vertical bounds of each opening 44 are defined by vertically spaced apart sets of louvers. Each louver comprises a canopy 32, a cap 34, and a fence 36. Each canopy runs outwardly and preferably downwardly relative to the center plane and the horizontal plane respectively. Each cap is integral with the outer end of a canopy. Each cap runs outwardly and downwardly relative to the center plane and the horizontal plane respectively of the chamber. The downward slope of the cap is greater than the downward slope of the canopy. The slope of the canopy may be very slight, even zero (i.e., horizontal). At the inner end of each canopy 34 is an upwardly running fence 36 which has a complex concave shape, as will be understood from further description just below.

The FIG. 7 is side elevation view of a portion of sidewall chamber 20, showing three louvers 50. Again, each louver 50 is comprised of a cap 34, a canopy 32 and fence 36. In FIG. 7, the canopy presents as a line at the top of cap 34 because the top surface of the canopy is essentially horizontal. The louvers define spaced apart openings. There are small see-through openings 44A each at the top edge of each fence 36. The see-through portion 44A is part of the total opening 44 defined by a louver. See FIG. 6 again.

Fence 36 is complexly shaped. In top view the edge 39 of the fence presents as a curve, the concavity of which faces outwardly. See FIG. 8. The opposing ends of each fence 36 are integral with the arch-curving sides 43 of the associated peak corrugation. See FIG. 8. As will be appreciated from consideration of the shape of tooling 46, 48 and from the side elevation view of FIG. 7, fence 36 is shaped like a portion of a bowl. In side elevation view of FIG. 7, a portion of the fence which is laterally innermost presents as a crescent. The portions of the fence which run from the lower edges of the crescent, to attach to the sides 43 of the peak corrugation 22, are curved in both the vertical plane and the horizontal plane. As shown in FIG. 7, when projected into the vertical center plane, the elevation of fence edge 39 dips toward the mid-point of the fence length; in other words, the fence edge is concave when projected into the vertical center plane.

Figure 10:
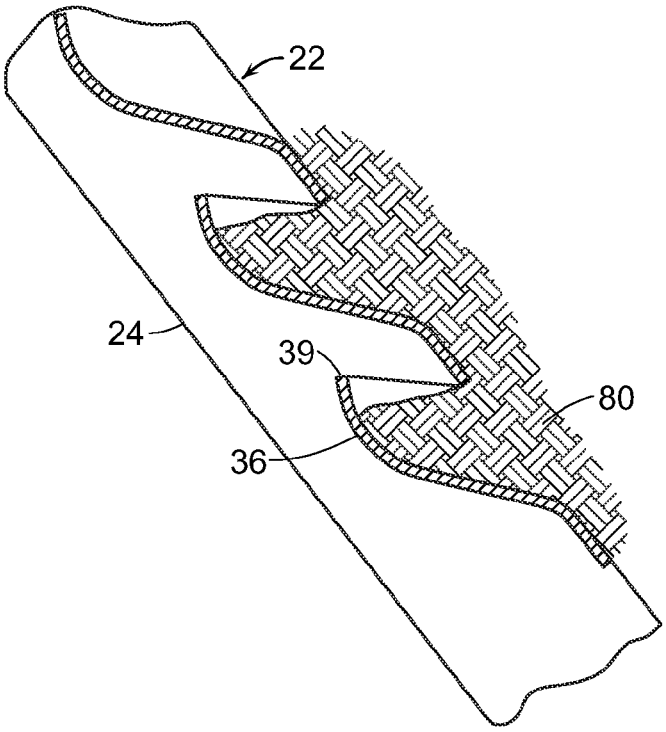
FIG. 10 is a transverse cross section through a portion of the sidewall of the chamber in FIG. 5, showing how soil surrounding the chamber partially enters the slot openings.

Fence 39 runs upwardly, discouraging sand and dirt outside of the chamber from moving into the chamber interior during use. FIG. 10 is a view like FIG. 6, showing soil 80 which is resting against the exterior of the chamber, and which is blocked from entering the chamber by the fence 36. A louver of the present invention has a non-planar undersurface. With reference to FIG. 6, the underside of a louver comprises the substantially planar (optionally curved) portion provided by the canopy 32, in combination with the down-sloping undersurface provided by cap 34.

As measured at the center of the length of a louver, the slope of the canopy is preferably about 0 to 5 degrees relative to the horizontal plane of the chamber. In embodiments of the invention, the slope angle of the canopy preferably will be in the range between 0 degrees (horizontal) and about 20 degrees. A downslope facilities flow of water into the soil due to force of gravity. Low angles of down slope tend to enable more slots in the vertical direction.

With reference to FIG. 6, as measured at the center of a louver, a preferred angle between the canopy and cap is about 50 degrees. In embodiments of the invention, the angle preferably will be in the range from about 20 degrees to about 80 degrees.

The canopy and the cap may be curved in the transverse direction of the chamber; in such instance, the slopes referred to herein shall be the slope of a plane/line which has a best-fit to the canopy or cap, as applies. As shown in several of the Figures here, the fence preferably tilts inwardly toward the vertical center plane of the chamber. The fence of a chamber of the present invention preferably has a concave shape upper edge, as the edge is projected into a horizontal plane of the chamber; and, the lengthwise ends of a fence curve outwardly, as can be seen in the partial cutaway of a preferred chamber in FIG. 8.

The louvers of the sidewalls of the present invention will contrast with the louvers of the prior art that have a wedge shape vertical cross section. In one embodiment, for instance if the chamber of the present invention is made by injection molding, the under surface of a louver canopy and cap may be equally spaced apart respectively from the top surfaces of the canopy and cap; in short, the louver will preferably have constant thickness. In another embodiment, such as when the chamber is thermoformed from sheet, the nature of the process, wherein sheet is differently stretched in different locations, can lead to louvers which are not precisely of uniform thickness, but which vary a bit in thickness. Particularly in the context of wedge cross section louvers, such louvers are still considered to have essentially constant thickness within the meaning of this description. In the same context, a thermoformed embodiment of the invention will be characterized a plurality of louvers, each comprised of integral canopy and cap portions, where the top surface of the integral portion is nominally congruent with the under surface of each portion.

Figure 11:
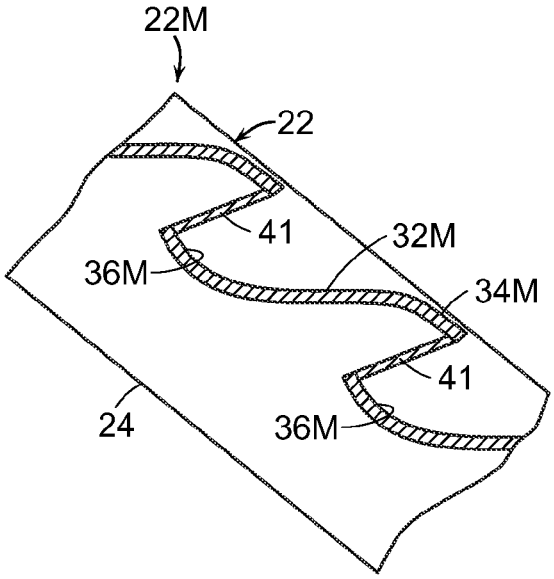
FIG. 11 is a partial transverse cross section of the sidewall of an alternative chamber precursor.

In another fabrication approach, a precursor chamber which is thermoformed may be subjected to a secondary operation which comprises making cuts in the sidewall, such as by means of a laser or water jet, followed by a die-forming operation (preferably with associated local heating of the sidewall portions being shaped). The die-forming contours the sidewall where it has been cut so fences in accord with the description above are produced. In still another approach, illustrated by FIG. 11, the sidewall undulations of a peak corrugation 22M may be thermoformed so they define caps 34M and canopies 32M, and instead of sub-walls 30, fences 36M with integral roofs 41. Each roof 41 connects the top of a fence and the outer end of a canopy. In a secondary operation, the roof 41 is cut away, to provide a chamber like chamber 20.

Figure 12:
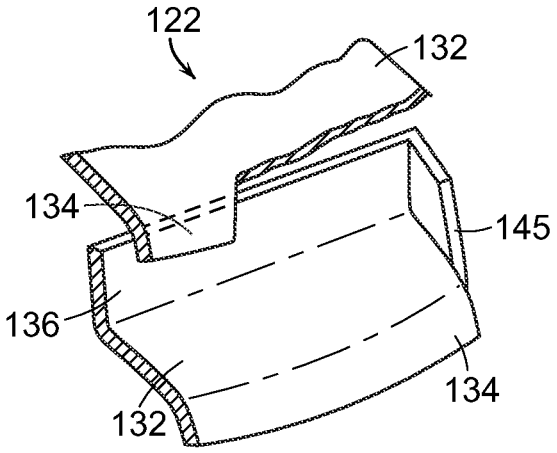
FIG. 12 is a view like FIG. 9, showing a concave fence which has nearing right angle ends.

A concave fence of the present invention may have a different shape from that shown for fence 36 in FIG. 8, which was created by the tool shown in FIG. 4B. For example, as shown in FIG. 12, a chamber peak corrugation 122 comprising canopies 132 and caps 134 has a fence 136 which is straight, and the ends 145 of the fence run nearly perpendicular to the fence; they meld into or are one with the sides of the corrugation.

Figure 13:
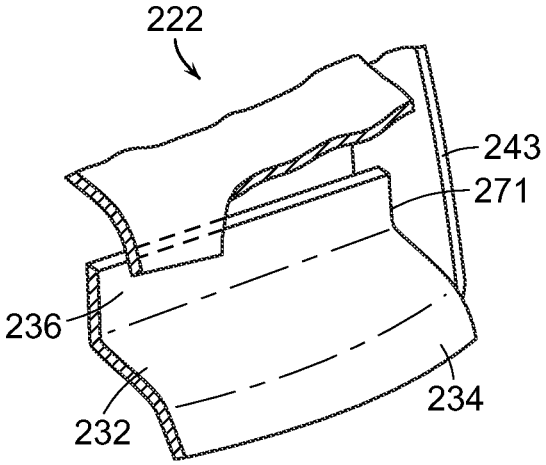
FIG. 13 is a view like FIG. 9, showing a straight fence.

Other shape fences may be employed. FIG. 13 shows a sidewall peak corrugation 222 comprising canopies 232 and caps 234. Fence 236 is straight; in another embodiment it may be curved and/or tilted. In this embodiment, the opposing ends of the fence may be connected, or may be not connected to the opposing corrugation sides 243. If the ends of the fence are connected to the sides 243, then the embodiment may be like that of FIG. 12. If the ends of the fence are not connected to the sides 243 and there is a space 271 between the end of the fence and the side 243, that space will be made small enough to prevent significant ingress of soil.

Chambers having the other-shape fences on the louvers may be difficult to make by thermoforming and mechanical forming, using the particular techniques described above. As mentioned elsewhere, chambers may alternatively be formed by other molding methods, as referred to below; and such other methods or combinations of such may be better suited to making certain alternative embodiments of chambers of the present invention.

As shown in exemplary drawings here, the openings 44 are preferably slot openings, wherein the opening length (the dimension in the chamber lengthwise direction) is substantially greater than the opening vertical dimension (opening height as projected into the center plane). Within the scope of the generality of the invention the openings may have other dimensions; for instance the height might be equal to the width.

Because PET has properties different from polypropylene (PP) which has been widely used in leaching chambers, a leaching chamber having the same dimensions and same overall performance as the exemplary chamber described above may weigh about 6.5 pounds when made of PET, compared to about 9 pounds when made of PP. This can result in significant cost savings with respect to material cost.

A leaching chamber has to sustain the load of overlying soil and possible vehicles traveling over the soil. Prior art injection molded PP chambers have a closely controlled basic wall thickness in the range 0.09-0.12 inch thick Thermoformed polyethylene (PE) and PP chambers have, by the nature of their fabrication, varying wall thickness; a result of different localized stretching of the sheet. Part of the skill in engineering and making a thermoformed product is to ensure the sheet is not unduly thin, to the point it is structurally inadequate to endure the stresses applied during use. To make a typical leaching chamber of the type described above from PET while using thermoforming, while meeting the well-known structural strength requirements (typically an H-10 load rating as determined by International Association of Plumbing and Mechanical Officials (IAPMO) Standard PS 63-2013), experimental work indicates that it may be necessary to thermoform a sheet of about 0.12 inch thickness.

A conventional way of making PET sheet is to extrude molten plastic through a die. PET may exist as an amorphous polymer or as a semi-crystalline polymer, generally as a function of its processing history or thermal exposure. When a PET sheet has portions which are crystallized, then the mechanical properties are altered compared to those portions which are in the amorphous state.

When PET is extruded in the conventional way for such thermoplastics, if the sheet is too thick there can be crystallization within the sheet, due to the whole of the sheet not cooling rapidly enough, to less than the glass transition temperature. Because a sheet having non-uniform morphology may locally behave like a brittle material, thermoforming becomes difficult. Commercial commodity-priced PET sheet with amorphous structure tends to be available only in thicknesses up to about 0.06 inches.

In an embodiment of the present invention, the chamber is comprised of a two layer sheet, where the layers are adhesively bonded to each other. In an example of this aspect of the invention, a first PET sheet of about 0.06 inch thickness is bonded to a second PET sheet of about 0.06 inch thickness by means of an adhesive, for example the hot melt adhesive Henkel Technomelt AS 8843 (Henkel Corporation, Rocky Hill, Conn., U.S.).

In one approach, a first flat sheet is bonded to a second flat sheet by spraying the adhesive on the surface of at least one of the sheets and then pressing them together to achieve a layered sheet of sufficient size to thermoform a chamber precursor. The resultant two-layer sheet is then thermoformed using known techniques, including one or more of vacuum, pressure, or mold parts, to make a thermoformed chamber as described herein.

In another approach a first sheet of about 0.06 inch thickness is thermoformed to the desired shape of a chamber; and then a second sheet of about the same thickness is then simultaneously thermoformed and bonded to the first sheet. The faying surface of either the first sheet or second sheet is coated with hot melt adhesive prior to the forming of the second sheet. When the first sheet is formed within a female mold, the second sheet will form the interior surface of the leaching chamber. When the first sheet is formed onto a male mold, the second sheet will form the exterior surface of the leaching chamber. The resultant chamber precursor and finished chamber comprises two layer sheet. (The sheet might be characterized as three-layer if the adhesive is counted. In this description, a reference to a layer is a reference to a plastic which is a structural plastic.)

In this aspect of the invention, a more-than two layer sheet may be formed. For example three layers may be used. And sheet thicknesses which are different from (especially thinner than) the sheets in the foregoing example may be used, as when a lesser total thickness can be used, as for example when a particular chamber load rating need not be met.

The methodology of making for thermoforming a sheet of PET (and any other thermoplastic which is susceptible to equivalent kind of limitation in sheet thickness related to amorphous-crystalline structure) is useful for making other articles than leaching chambers. For example, it is well known that a variety of industrial and consumer articles can be thermoformed of thermoplastics PE and PP, using sheet as the starting material. The invention may be used to manufacture those.

Other methods of forming an invention chamber may be used as alternative to thermoforming. For example, use may be made of blow molding, compression molding or injection molding, with secondary fabrication, including cutting or forming as required. In blow molding, a boule would be expanded to form a container shape, the lengthwise cutting of which would provide two chamber precursors; the sidewall openings may be formed by tooling as described above. In compression molding, powdered plastic or sheet would be consolidated by pressure after being placed within the space defined by the female and male parts of a closed mold. In injection molding, molten plastic would be injected into cooled metal molds, each comprised of a core part and a cavity part. As is the case with current technology injection molded PP and PE chambers, in most instance no secondary operation of consequence will be required; the sidewall openings will be present when the chamber is removed from the mold.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention. When articles are described in terms of orientation in space, for instance with respect to a horizontal plane, top, bottom, etc., such description is for simplicity of description and shall not be limiting with respect to an article which is oriented differently than the object described, for example, if a chamber is tilted on its side or upside down.

What is claimed is:

1. An arch shape cross section corrugated plastic chamber having opposing side base flanges running lengthwise along the chamber, the flanges lying in a horizontal plane, and opposing sidewalls, each sidewall running upwardly from a base flange to a top of the chamber; the chamber having a lengthwise center plane which is perpendicular to said horizontal plane; wherein each chamber sidewall comprises:

a plurality of alternating peak corrugations and valley corrugations running transverse to the length of the chamber, each peak corrugation having an arch-curving sides where the peak mates with adjacent valleys and a plurality of vertically spaced apart openings, wherein the vertical boundaries of each opening are defined by spaced apart louvers, each louver running lengthwise within the peak corrugation of the sidewall, each louver comprising (a) a canopy running outwardly relative to said center plane and with no slope or a downward slope relative to said horizontal plane, the canopy having a top surface and an under surface, and an inner end and an outer end;

(b) a cap, integral with the outer end of the canopy, running outwardly relative to said center plane and sloping downwardly relative to said horizontal plane, wherein the slope of the cap is greater than the slope of the canopy, the cap having a top surface and an under surface, and an inner end and an outer end; and, (c) a fence integral with the inner end of each canopy the fence running upwardly from said inner end of the canopy to an upper fence edge;

wherein said top surface and said under surface of the canopy are nominally congruent with each other and said top surface and said under surface of the cap are nominally congruent with each other.

2. The chamber of claim 1 wherein each opening is slot shaped.

3. The chamber of claim 1 wherein the ends of each fence are connected to the arch-curving sides of the peak corrugation.

4. The chamber of claim 1 wherein the upper edge of each fence has a concave shape, as projected into the horizontal plane.

5. The chamber of claim 4 wherein the opposing end portions of the fence are curved in both a vertical plane and a horizontal plane of the chamber.

6. The chamber of claim 1 wherein the upper edge of the fence has a concave shape when projected into the vertical center plane.

7. The chamber of claim 1 wherein the angle, measured in a plane which is perpendicular to the lengthwise center plane, between the canopy and the cap is in the range of 20 to 80 degrees; wherein the angle, measured in a plane which is perpendicular to the lengthwise center plane, of the top surface of the canopy is in the range of 0 to 20 degrees.

8. The chamber of claim 1 made of polyethylene terephthalate (PET).

9. The chamber of claim 8 wherein the PET material comprises a first layer and a second layer, the layers joined to each other by an adhesive.

10. The chamber of claim 1, made by first, thermoforming plastic sheet to form a chamber precursor having said arch shape cross section, base flanges, top, sidewalls, and corrugations, the chamber precursor having a plurality of undulations along at least a plurality of the peak corrugations of each sidewall; and, second, cutting and deforming the chamber precursor sidewall at the location of each undulation, so a portion of the peak corrugation moves inwardly toward the center of the chamber, to thereby form said openings, the plurality of spaced apart louvers and said fences.

11. A method of forming an arch shape cross section corrugated thermoplastic leaching chamber in accord with claim 1, which comprises:

thermoforming plastic sheet to form a chamber precursor having said arch shape cross section, base flanges, top, sidewalls, and corrugations, the chamber precursor having a plurality of undulations along at least a plurality of the peak corrugations of said opposing sidewalls; and, cutting and deforming the chamber precursor sidewall at the location of each undulation, so a portion of the peak corrugation moves inwardly toward the center of the chamber, to thereby produce a chamber having a plurality of louvers, each pair of louvers defining a slot opening in the peak corrugation, each louver having a fence at the inner portion of the louver.

12. The method of claim 11 further comprising shaping each undulation during the thermoforming step so that each undulation comprises (a) a canopy extending transverse to the width of the chamber, (b) a cap integral with the outer end of the canopy, wherein the cap has down-slope relative to the plane of the base flange is greater than the angle of the canopy to same, and (c) a subwall that connects the inner end of the canopy with the outer end of the cap, wherein the deforming step pushes the subwall inwardly to form the fence.

13. The method of claim 12, wherein each fence has ends which are connected to the sides of the peak corrugation and which are curved in both a vertical plane and a horizontal plane of the chamber.

14. The method of claim 11 wherein each fence has an upper edge which is concave as projected into the horizontal base plane of chamber.

15. The method of claim 11 further comprising: forming the plastic sheet used to make the chamber precursor by adhesively bonding a first plastic layer to a second plastic layer, wherein the plastic of the sheet comprises polyethylene terephthalate (PET).

16. An arch shape cross section corrugated plastic chamber having opposing side base flanges running lengthwise along the chamber, the flanges lying in a horizontal plane, and opposing sidewalls, each sidewall running upwardly from a base flange to a top of the chamber; the chamber having a lengthwise center plane which is perpendicular to said horizontal plane; wherein each chamber sidewall comprises:

a plurality of alternating peak corrugations and valley corrugations running transverse to the length of the chamber, each peak corrugation having an arch-curving sides where the peak mates with adjacent valleys and a plurality of vertically spaced apart slot openings, wherein the vertical boundaries of each slot opening are defined by spaced apart louvers, each louver running lengthwise within the peak corrugation of the sidewall, each louver comprising (a) a canopy running outwardly relative to said center plane and with no slope or a downward slope relative to said horizontal plane, the canopy having a top surface and an under surface, and an inner end and an outer end;

(b) a cap, integral with the outer end of the canopy, running outwardly relative to said center plane and sloping downwardly relative to said horizontal plane, wherein the slope of the cap is greater than the slope of the canopy, the cap having a top surface and an under surface, and an inner end and an outer end; and, (c) a fence integral with the inner end of each canopy, the fence running upwardly from said inner end of the canopy to an upper fence edge having a concave shape, as projected into both the horizontal plane and the vertical center plane, the fence having opposing lengthwise ends which are connected to said sides of the peak corrugation.

* * * * *